US011422493B2

(12) United States Patent
Tsuchihashi et al.

(10) Patent No.: US 11,422,493 B2
(45) Date of Patent: Aug. 23, 2022

(54) IMAGE HEATING DEVICE, IMAGE FORMING APPARATUS, AND HEATER

(71) Applicant: Canon Kabushiki Kaisha, Tokyo (JP)

(72) Inventors: Naoto Tsuchihashi, Kanagawa (JP); Eiji Uekawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/177,593

(22) Filed: Feb. 17, 2021

(65) Prior Publication Data

US 2021/0255570 A1 Aug. 19, 2021

(30) Foreign Application Priority Data

Feb. 18, 2020 (JP) ..... JP2020-025444

(51) Int. Cl.
*G03G 15/20* (2006.01)

(52) U.S. Cl.
CPC ..... *G03G 15/2053* (2013.01); *G03G 15/2039* (2013.01); *G03G 15/2064* (2013.01)

(58) Field of Classification Search
CPC ..... G03G 15/2039
See application file for complete search history.

(56) References Cited

U.S. PATENT DOCUMENTS

| | | | |
|---|---|---|---|
| 7,203,438 | B2 | 4/2007 | Omata et al. |
| 9,235,166 | B2 | 1/2016 | Shimura |
| 10,459,379 | B2 | 10/2019 | Shimura |
| 10,983,461 | B2 | 4/2021 | Kurata |
| 10,996,595 | B2 | 5/2021 | Sako et al. |
| 2014/0270835 | A1 | 9/2014 | Umezawa |
| 2015/0055968 | A1 | 2/2015 | Kadowaki |
| 2016/0306305 | A1* | 10/2016 | Yamada ..... G03G 15/2042 |
| 2019/0212686 | A1 | 7/2019 | Mori |

FOREIGN PATENT DOCUMENTS

| | | | |
|---|---|---|---|
| JP | 2014059508 | A | 4/2014 |
| JP | 2017092039 | A | 5/2017 |
| JP | 2019215473 | A | 12/2019 |
| JP | 2020016843 | A | 1/2020 |

OTHER PUBLICATIONS

Extended European Search Report dated Aug. 17, 2021 in counterpart European Patent Appln. No. 21157540.2.
Co-pending U.S. Appl. No. 17/177,580, filed Feb. 17, 2021.

* cited by examiner

*Primary Examiner* — Sevan A Aydin
(74) *Attorney, Agent, or Firm* — Venable LLP

(57) ABSTRACT

In an image heating device including a heater including a substrate, a first conductor provided on the substrate, a second conductor provided at a position different from the first conductor on the substrate in a direction orthogonal to a longitudinal direction of the substrate, and a plurality of heat-generating resistors, each having the same shape and electrically connected in parallel between the first conductor and the second conductor on the substrate and a plurality of temperature detection elements for detecting a temperature of the heater and heating an image formed on a recording material by the heater, the plurality of temperature detection elements includes at least two temperature detection elements whose relative positions with respect to the closest heat-generating resistor in the plurality of heat-generating resistors are the same, respectively, the closest heat-generating resistors corresponding to the at least two temperature detection elements are independently controlled.

11 Claims, 12 Drawing Sheets

ENLARGED VIEW OF PORTION L

ENLARGED VIEW OF PORTION C

ENLARGED VIEW OF PORTION R

ENLARGED VIEW OF PORTION L

ENLARGED VIEW OF PORTION C

ENLARGED VIEW OF PORTION R

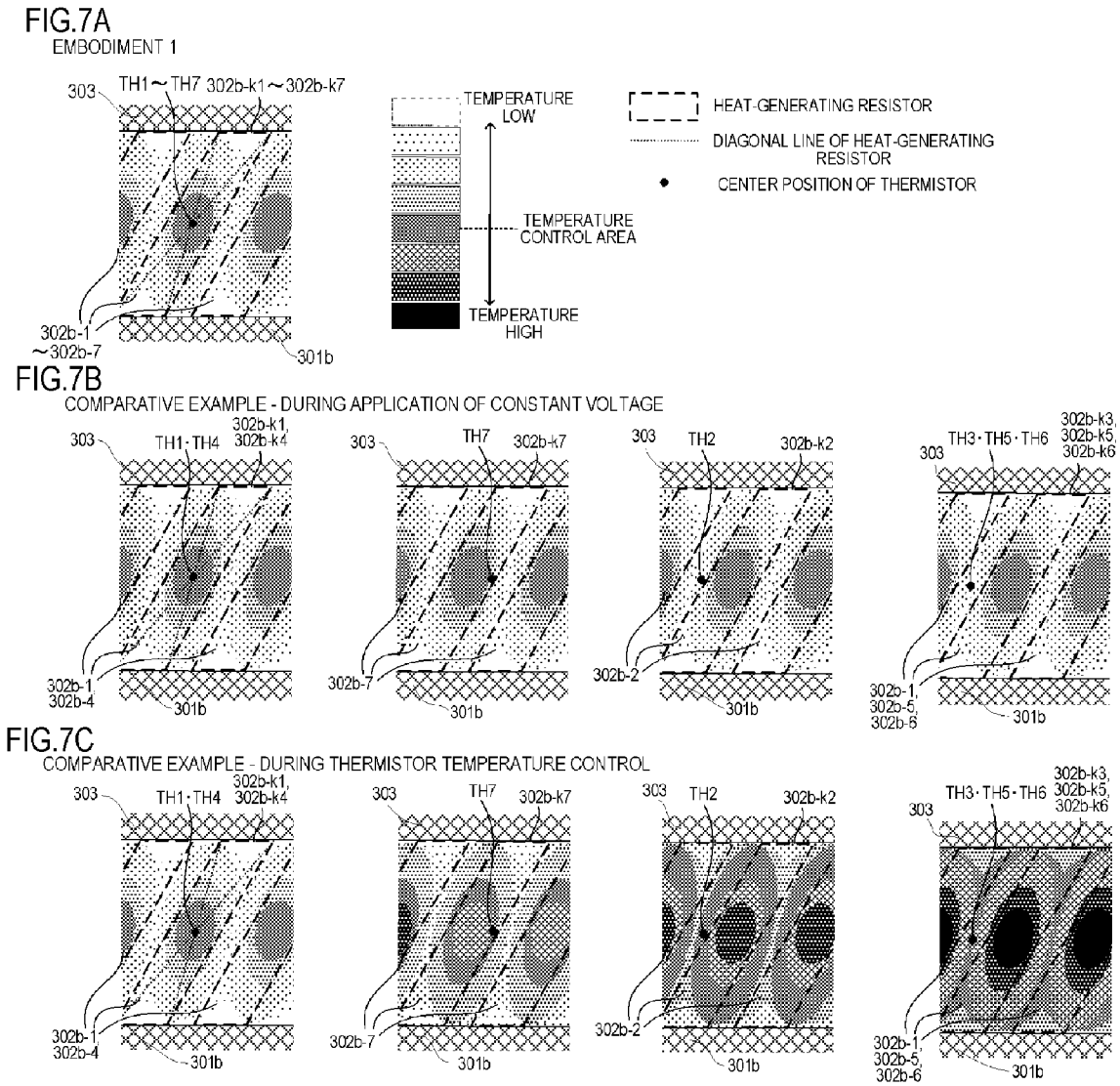
FIG.7A
EMBODIMENT 1
303
TH1～TH7
302b-k1～302b-k7
302b-1
～302b-7
301b
TEMPERATURE LOW
TEMPERATURE CONTROL AREA
TEMPERATURE HIGH
HEAT-GENERATING RESISTOR
DIAGONAL LINE OF HEAT-GENERATING RESISTOR
CENTER POSITION OF THERMISTOR
FIG.7B
COMPARATIVE EXAMPLE - DURING APPLICATION OF CONSTANT VOLTAGE
TH1·TH4
302b-k1, 302b-k4
302b-1, 302b-4
TH7
302b-k7
302b-7
TH2
302b-k2
302b-2
TH3·TH5·TH6
302b-k3, 302b-k5, 302b-k6
302b-1, 302b-5, 302b-6
FIG.7C
COMPARATIVE EXAMPLE - DURING THERMISTOR TEMPERATURE CONTROL

IMAGE HEATING DEVICE, IMAGE FORMING APPARATUS, AND HEATER

BACKGROUND OF THE INVENTION

Field of the Invention

The present invention relates to an image heating device such as a fixing unit installed in an image forming apparatus such as a copier and a printer that uses an electrophotographic system and an electrostatic recording system or a gloss providing device for improving gloss of a toner image by heating again a fixed toner image on a recording material. Moreover, the present invention relates to a heater used in this image heating device.

Description of the Related Art

As an image heating device, there is a device having a cylindrical film called an endless belt, an endless film, and the like, and a heater in contact with an inner surface of the film, and a roller forming a nip portion with the heater through the film. In an image forming apparatus on which this image heating device is installed, there is a case in which a paper size narrower than a maximum paper passable width in a direction orthogonal to a paper passing direction (a conveying direction of the recording material) is continuously printed. In this case, such a phenomenon occurs that a temperature of an area where the paper (recording material) does not pass in a nip-portion longitudinal direction (hereinafter, referred to as a paper non-passing portion) gradually increases (a temperature rise in the paper non-passing portion). In the image heating device, it should be so constituted that the temperature of the paper non-passing portion does not exceed an upper-temperature limit of each member in the apparatus.

As one of methods for suppressing the temperature rise in the paper non-passing portion, a heater and an image heating device described in Japanese Patent Application Publication No. 2014-59508 are proposed. That is, an electric current is made to flow in a short-side direction of the heater (a direction in parallel with the conveying direction of the recording material) by disposing two conductors along a longitudinal direction of a heater substrate as illustrated in FIG. 11 and by disposing a plurality of heat-generating resistor elements (hereinafter, referred to as a heat-generating resistor) in parallel between the conductors. Moreover, a heat-generating block made of a set of the conductor and the heat-generating resistor is divided at a position corresponding to a recording material size in the longitudinal direction of the heater, and a current-carrying amount to each of the heat-generating blocks is controlled in accordance with the size of the recording material to be passed. In order to control the current-carrying amount to each of the heat-generating blocks, each of the heat-generating blocks has a control thermistor as a temperature detection element for detecting a temperature of each of the heat-generating blocks.

SUMMARY OF THE INVENTION

In the heat-generating blocks illustrated in FIG. 11, the heat-generating resistor generates heat, while spots other than the heat-generating resistors do not generate heat, and thus, there is temperature distribution in the heat-generating blocks.

A reference example of relative positional relations of the control thermistors (temperature detection elements) with respect to the heat-generating resistors will be explained by using FIGS. 12A to 12C. FIG. 12A is a schematic view of a back surface of the heater, while FIG. 12B is a schematic view of a front surface of the heater, and they illustrate positional relations of each of the heat-generating blocks and each of the control thermistors corresponding to that. Reference character L in the figures is a center line in the short-side direction of the heater. FIG. 12C schematically illustrates temperature distribution on L in each of the heat-generating blocks when all the heat-generating blocks generate heat.

As illustrated in FIGS. 12A to 12C, in a heat-generating block A1, a control thermistor TH1 is disposed at a position corresponding to the heat-generating resistor (disposed so that each of gravity-center positions on a plan-view shape when seen in a direction perpendicular to a surface of a substrate overlaps each other) and is located at a spot with high temperature distribution in the heat-generating block A1 (position where a maximum value is detected). Moreover, in a heat-generating block A2, a control thermistor TH2 is disposed at a position where there is no heat-generating resistor (disposed at a position not overlapping the heat-generating resistor when seen in the direction perpendicular to the surface of the substrate) and is located at a spot with low temperature distribution in the heat-generating block A2 (position where a minimum value is detected). In a heat-generating block A3, a control thermistor TH3 is disposed at a position partially overlapping the heat-generating resistor when seen in a direction perpendicular to the surface of the substrate (position where an area of substantially a half of a plan-view shape overlaps the heat-generating resistor) and is located substantially at the center of temperature distribution in the heat-generating block A3 (position where an intermediate value between the maximum value and the minimum value is detected).

As described above, when the positional relations between the control thermistor and the heat-generating resistor are different depending on the heat-generating block, if temperature control is executed at the same temperature, a difference is generated in average temperatures among the heat-generating blocks as illustrated in FIG. 12C, and there is a possibility that longitudinal non-uniformity can occur in fixing performance and gloss.

An object of the present invention is to provide an art which enables highly accurate temperature control.

In order to achieve the above-mentioned object, an image heating device of the present invention includes the following:

a heater having a substrate, a first conductor provided on the substrate along a longitudinal direction of the substrate, a second conductor provided along the longitudinal direction at a position different from the first conductor on the substrate in a direction orthogonal to the longitudinal direction, and a plurality of heat-generating resistors, each having the same shape and electrically connected in parallel between the first conductor and the second conductor on the substrate;

a plurality of temperature detection elements for detecting a temperature of the heater; and a control portion for controlling electricity to be supplied to the heat-generating resistors based on the temperature detected by the temperature detection elements, wherein the image heating device heats an image formed on a recording material by using a heat of the heater; and wherein the plurality of temperature detection elements include at least two temperature detection elements whose relative positions with respect to the closest heat-generating resistor in the plurality of heat-generating resistors are the same, respectively, the closest heat-generating resistors corresponding to the at least two temperature detection elements are independently controlled by the control portion.

In order to achieve the above-mentioned object, an image forming apparatus of the present invention includes the following:

an image forming portion for forming an image on a recording material; and a fixing portion for fixing the image formed on the recording material to the recording material, wherein the fixing portion is the image heating device of the present invention.

In order to achieve the above-mentioned object, a heater used for heating of an image formed on a recording material of the present invention includes the following:

a substrate;

a first conductor provided on the substrate along a longitudinal direction of the substrate;

a second conductor provided along the longitudinal direction at a position different from the first conductor on the substrate in a direction orthogonal to the longitudinal direction;

a plurality of heat-generating resistors, each having the same shape and electrically connected in parallel between the first conductor and the second conductor on the substrate; and a plurality of temperature detection elements provided on a surface of the substrate on a side opposite to a surface on which the first conductor, the second conductor, and the heat-generating resistors are provided, wherein the plurality of temperature detection elements include at least two temperature detection elements whose relative positions with respect to the closest heat-generating resistor in the plurality of heat-generating resistors are the same, respectively, the closest heat-generating resistors corresponding to the at least two temperature detection elements are independently controlled.

According to the present invention, highly accurate temperature control is made possible.

Further features of the present invention will become apparent from the following description of exemplary embodiments with reference to the attached drawings.

BRIEF DESCRIPTION OF THE DRAWINGS

FIGS. 7A to 7C are temperature distribution diagrams in the neighborhood of the thermistor;

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Hereinafter, a heater, an image heating device, and an image forming apparatus according to an embodiment 1 of the present invention will be described in more detail by using drawings. As the image forming apparatus to which the present invention can be applied, a printer, a copier and the like using an electrophotographic system and an electrostatic method are cited, and a case in which the present invention is applied to a laser printer will be described here.

Embodiment 1

1. Constitution of Image Forming Apparatus

Figure 1:
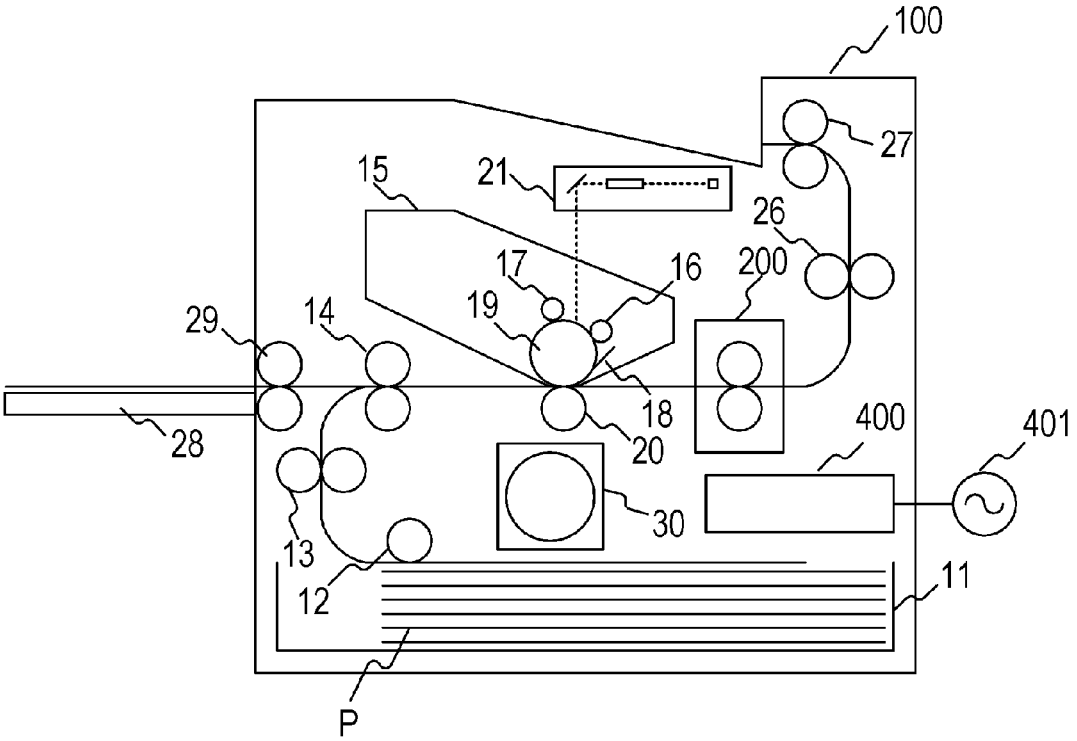
FIG. 1 is a sectional view of an image forming apparatus.

FIG. 1 is a schematic sectional view of an image forming apparatus according to an embodiment 1 of the present invention. The image forming apparatus 100 in this embodiment is a laser printer for forming an image using the electrophotographic system.

When a print signal is generated, a laser beam modulated in accordance with image information is emitted by a scanner unit 21, and a surface of a photosensitive drum 19 charged to a predetermined polarity by a charging roller 16 is scanned. As a result, an electrostatic latent image is formed on the photosensitive drum 19. When a toner is supplied from a developing roller 17 to this electrostatic latent image, the electrostatic latent image on the photosensitive drum 19 is developed as a toner image (toner image). On the other hand, a recording material (recording paper) P loaded on a paper-feed cassette 11 is supplied one by one by a pickup roller 12 and conveyed to a resist roller pair 14 by a conveying roller pair 13. Moreover, the recording material P is conveyed to a transfer position from the resist roller pair 14 at timing when the toner image on the photosensitive drum 19 reaches the transfer position formed by the photosensitive drum 19 and a transfer roller 20. In the course during which the recording material P passes the transfer position, the toner image on the photosensitive drum 19 is transferred to the recording material P. After that, the recording material P is heated by using a heat of a heater in a fixing apparatus 200 as a fixing portion (image heating portion), and the toner image is heated/fixed to the recording material P. The recording material P carrying the fixed toner image is ejected to a tray on an upper part of the image forming apparatus 100 by conveying roller pairs 26 and 27.

A drum cleaner 18 cleans the toner remaining on the photosensitive drum 19. A paper-feed tray 28 (manual feed tray) having a pair of recording-material regulating plate capable of adjusting a width in accordance with a size of the recording material P is provided in order to handle also the recording material P of the sizes other than a standard size. A pickup roller 29 feeds the recording material P from the paper-feed tray 28. The image forming apparatus body 100 has a motor 30 for driving the fixing apparatus 200 and the like. A control circuit 400 as heater driving portion and electrification control portion connected to a commercial AC power supply 401 performs power supply to the fixing apparatus 200.

The photosensitive drum 19, the charging roller 16, the scanner unit 21, the developing roller 17, and the transfer roller 20 described above constitute an image forming portion forming an unfixed image on the recording material P. In this embodiment, the charging roller 16, a development unit including the developing roller 17 and the photosensitive drum 19 and a cleaning unit including the drum cleaner 18 are constituted as a process cartridge 15, detachably with respect to an apparatus body of the image forming apparatus 100.

The image forming apparatus 100 in this embodiment has a maximum paper-passing width of 215.9 mm in a direction orthogonal to a conveying direction of the recording material P and a minimum paper-passing width of 76.2 mm. On the paper-feed cassette 11, Letter-sized paper (215.9 mm×279.4 mm), Legal-sized paper (215.9 mm×355.6 mm), A4-sized paper (210 mm×297 mm), 16K-sized paper (195 mm×270 mm), Executive-sized paper (184.2 mm×266.7 mm), JIS B5-sized paper (182 mm×257 mm), A5-sized paper (148 mm×210 mm) and the like can be set.

Moreover, nonstandard size paper including index card 3×5 inches (76.2 mm×127 mm), DL envelope (110 mm×20 mm), and C5 envelope (162 mm×229 mm) can be fed from the paper-feed tray 28 for being printed. Furthermore, a paper-passing standard of the recording material P in the image forming apparatus in this embodiment is a guide center, and each of the recording material P is passed in a state with the center lines in the direction orthogonal to the conveying direction thereof aligned.

2. Constitution of Fixing Apparatus (Fixing Portion)

Figure 2:
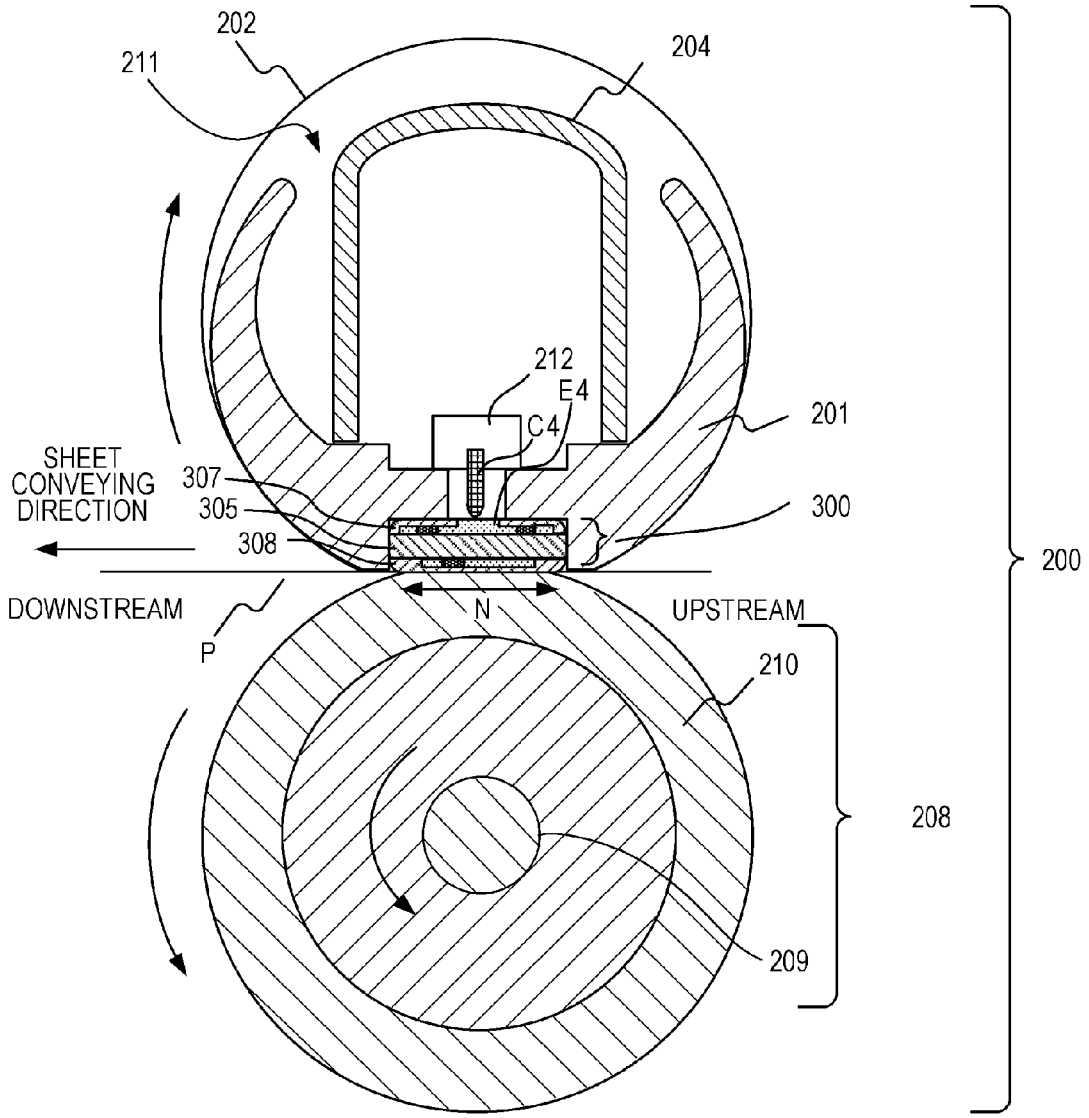
FIG. 2 is a sectional view of an image heating device in an embodiment 1.

FIG. 2 is a schematic sectional view of the fixing apparatus 200 as an image heating device of this embodiment. The fixing apparatus 200 has a fixing film 202 as a heating rotating member (heating member), a heater 300 disposed on an inner side of the fixing film 202 as a heat source, a pressurizing roller 208 as a pressurizing rotating member (pressurizing member) in contact with an outer surface of the fixing film 202, and a metal stay 204. The heater 300, a heater holding member 201 which will be described later, and the metal stay 204 constitute a heater unit 211. The pressurizing roller 208 is pressed into contact with the heater 300 through the fixing film 202 and forms a fixing nip portion N between itself and the fixing film 202.

The fixing film 202 is a plural-layered heat-resistant film formed cylindrically and has a heat-resistant resin such as polyimide or metal such as stainless as a base layer. Moreover, a surface of the fixing film 202 is coated with a heat-resistant resin excellent in release performance such as tetrafluoroethylene/perfluoro alkyl vinyl ether copolymer (PFA) and the like so as to form a release layer in order to ensure prevention of adhesion of a toner and separativeness from the recording material P.

The pressurizing roller 208 has a core metal 209 of a material such as iron, aluminum and the like and an elastic layer 210 of a material such as silicone rubber and the like. The heater 300 is held by the heater holding member 201 made of a heat-resistant resin and heats the fixing film 202. The heater holding member 201 also has a guiding function for guiding rotation of the fixing film 202. The metal stay 204 biases the heater holding member 201 toward the pressurizing roller 208 upon receipt of a pressurizing force, not shown. The pressurizing roller 208 rotates in an arrow direction in the drawing upon receipt of power from the motor 30. By means of rotation of the pressurizing roller 208, the fixing film 202 follows and rotates. By giving a heat of the fixing film 202 while sandwiching/conveying the recording material P at the fixing nip portion N, the unfixed toner image on the recording material P is fixed/processed.

The heater 300 is a heater heated by a heat-generating resistor provided on a substrate 305 made of ceramics. A surface protection layer 308 provided on a side of the fixing nip portion N is glass used for obtaining slidability of the fixing nip portion N. A surface protection layer 307 provided on a side opposite to the fixing nip portion N is glass used for insulating the heat-generating resistor. A plurality of electrodes (here, an electrode E4 is illustrated as a representative) and electric contacts (here, an electrode C4 is illustrated as a representative) are provided on the side opposite to the fixing nip portion N, and power is fed to each of the electrodes from each of the electric contacts. The heater 300 will be explained in detail in FIG. 3.

Moreover, a safety element 212 such as a thermo switch, a temperature fuse and the like operated by abnormal heat generation of the heater 300 and shutting off power to be supplied to the heater 300 is in contact with the heater 300 directly or indirectly through the holding member 201.

3. Constitution of Heater

Figure 3A:
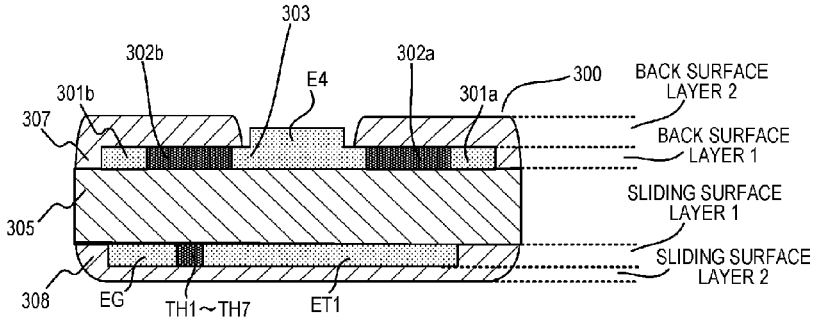
FIGS. 3A to 3C are heater configuration diagrams in the embodiment 1.

Constitution of the heater 300 according to this embodiment will be explained by using FIGS. 3A to 3C. FIG. 3A is a sectional view of the heater 300, FIG. 3B is a plan view of each layer of the heater 300, and FIG. 3C is a diagram for explaining a connecting method of the electric contact C to the heater 300.

Figure 3B:
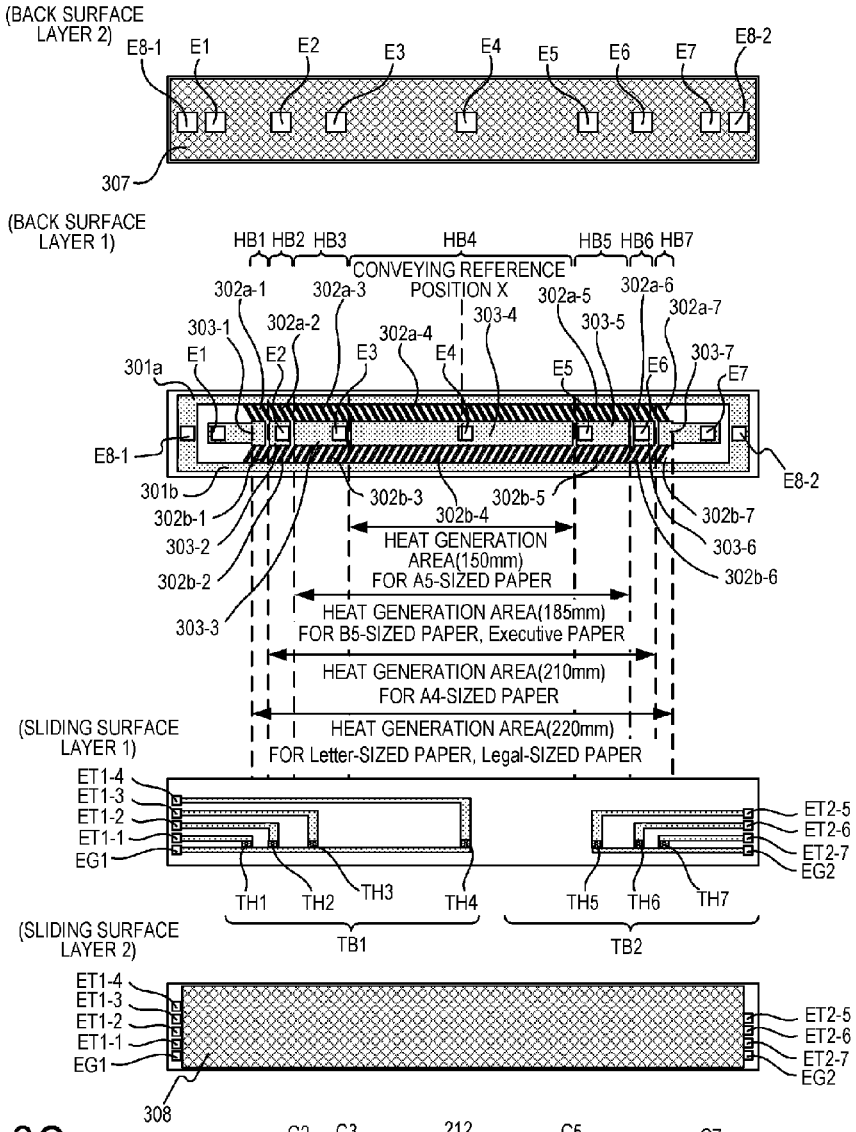
Figure 3C:
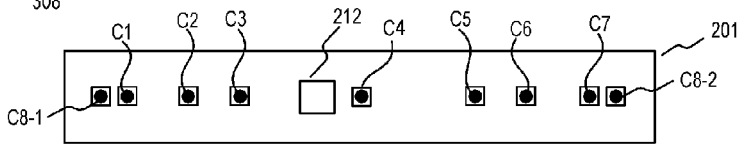

FIG. 3B illustrates a conveying reference position X of the recording material P in the image forming apparatus 100 of this embodiment. The conveying reference in this embodiment is the guide center, and the recording material P is conveyed so that the center line in the direction orthogonal to the conveying direction thereof follows the conveying reference position X. Moreover, FIG. 3A is a sectional view of the heater 300 at the conveying reference position X.

The heater 300 is constituted by a substrate 305 made of ceramics, a back surface layer 1 provided on the substrate 305, a back surface layer 2 covering the back surface layer 1, a sliding surface layer 1 provided on a surface of the substrate 305 on a side opposite to the back surface layer 1, and a sliding surface layer 2 covering the sliding surface layer 1.

The back surface layer 1 has a first conductor 301 (301*a*, 301*b*) provided along the longitudinal direction of the heater 300. The conductor 301 is separated into the conductor 301*a* and the conductor 301*b*, and the conductor 301*b* is disposed on a downstream side in the conveying direction of the recording material P with respect to the conductor 301*a*.

Moreover, the back surface layer 1 has a second conductor 303 (303-1 to 303-7) provided in parallel with the conductors 301*a* and 301*b*. The conductor 303 is provided along the longitudinal direction of the heater 300 between the conductor 301*a* and the conductor 301*b*. Furthermore, the back surface layer 1 has a heat-generating resistor 302*a* (302*a*-1 to 302*a*-7) on an upstream side in the recording-material conveying direction and a heat-generating resistor 302*b* (302*b*-1 to 302*b*-7) on a downstream side as heat-generating resistor elements (heat generating body) which generates heat by electricity.

Each of the heat-generating resistors 302*a* and 302*b* has a plan-view shape formed by a point-symmetrical parallelogram when seen in a direction perpendicular to the surface of the substrate 305, and a thickness (height from the substrate 305) is formed uniformly. Moreover, the heat-generating resistor 302*a* is disposed on the upstream side in the recording-material conveying direction and the heat-generating resistor 302*b* on the downstream side in the recording-material conveying direction with respect to a center in the heater short-side direction so as to be line symmetric to each other. And the heat-generating resistors 302*a* and 302*b* are provided in plural in a row in the longitudinal direction, respectively, and electrically connected in parallel between the first conductor 301 and the second conductor 303. The heat-generating resistors 302*a* and 302*b* are disposed having a plan-view shape extending in a direction inclined to the longitudinal direction and the short-side direction of the heater 300. By means of such disposition, an influence of a gap portion between a plurality of divided heat-generating resistors can be reduced, and uniformity of the heat generation distribution can be improved in the longitudinal direction of the heater 300.

A heat-generating portion constituted by the conductor 301 and the conductor 303 as well as the heat-generating resistor 302*a* and the heat-generating resistor 302*b* is divided into seven heat-generating blocks HB (HB1 to HB7) with respect to the longitudinal direction of the heater 300. That is, the heat-generating resistor 302*a* is divided into seven areas of the heat-generating resistors 302*a*-1 to 302*a*-7 with respect to the longitudinal direction of the heater 300. Moreover, the heat-generating resistor 302*b* is divided into seven areas of the heat-generating resistors 302*b*-1 to 302*b*-7 with respect to the longitudinal direction of the heater 300. The number of the heat-generating resistors 302*a* and 302*b* of each of the heat-generating blocks is two for the HB1 and HB7, three for the HB2 and HB6, seven for the HB3 and HB5, and 27 for the HB4.

Moreover, the conductor 303 is divided into seven areas of the conductors 303-1 to 303-7 in accordance with division positions of the heat-generating resistors 302*a* and 302*b*. A division width of the heat-generating block HB is a division width that can handle A5-sized paper, B5-sized paper, A4-sized paper: Letter-sized paper as described in FIG. 3B. However, the number of divisions and the division widths are not limited to them.

The back surface layer 1 has the electrode E (E1 to E7 and E8-1, E8-2). The electrodes E1 to E7 are provided within an area of each of the conductors 303-1 to 303-7 and they are electrodes for supplying electricity to each of the heat-generating blocks HB1 to HB7 through the conductors 303-1 to 303-7. The electrodes E8-1 and E8-2 are provided so as to be connected to the conductor 301 on an end portion in the longitudinal direction of the heater 300 and they are electrodes for supplying electricity to the heat-generating blocks HB1 to HB7 through the conductor 301. In this embodiment, the electrodes E8-1 and E8-2 are provided on both ends in the longitudinal direction of the heater 300, but such a structure in which only the electrode E8-1 is provided on one side (that is, the structure in which the electrode E8-2 is not provided) may be employed, for example. Moreover, power supply is performed by the common electrode to the conductors 301*a* and 301*b*, but individual electrodes may be provided for each of the conductor 301*a* and the conductor 301*b*, and power supply may be performed, respectively.

The back surface layer 2 is constituted by the surface protection layer 307 (glass in this embodiment) having insulation properties, and it covers the conductor 301, the conductor 303, and the heat-generating resistors 302*a* and 302*b*. Moreover, the surface protection layer 307 is formed excluding the spot of the electrode E so that the electric contact C can be connected to the electrode E from the back surface layer 2 side of the heater in the constitution.

The sliding surface layer 1 is provided on a surface of the substrate 305 on a side opposite to the surface on which the back surface layer 1 is provided and has a thermistor TH (TH1 to TH7) as a temperature detection element for detecting a temperature of each of the heat-generating blocks HB1 to HB7. The thermistor TH is made of a material having a PTC characteristic or an NTC characteristic and can detect the temperatures of all the heat-generating blocks by detecting resistance values thereof.

Moreover, the sliding surface layer 1 has a conductor ET (ET1-1 to ET1-4 and ET2-5 to ET2-7) and a conductor EG (EG1 and EG2) in order to electrify the thermistor TH and to detect the resistance value thereof. The conductors ET1-1 to ET1-4 are connected to the thermistors TH1 to TH4, respectively. The conductors ET2-5 to ET2-7 are connected to the thermistors TH5 to TH7, respectively. The conductor EG1 is connected to the four thermistors TH1 to TH4 and forms a common conductive path. The conductor EG2 is connected to the three thermistors TH5 to TH7 and forms a common conductive path. The conductor ET and the conductor EG are formed along the longitudinal of the heater 300 to a longitudinal end portion, respectively, and is connected to the control circuit 400 through an electric contact, not shown, on the heater longitudinal end portion.

The sliding surface layer 2 is constituted by a surface protection layer 308 (glass in this embodiment) having slidability and insulation properties, covers the thermistor TH, the conductor ET, and the conductor EG, and ensures slidability with an inner surface of the fixing film 202. Moreover, the surface protection layer 308 is formed by excluding the longitudinal both end portions of the heater 300 in order to provide the electric contact on the conductor ET and the conductor EG.

Subsequently, a connecting method of the electric contact C to each of the electrodes E will be explained. FIG. 3C is a plan view of a state where the electric contact C is connected to each of the electrodes E when seen from the heater holding member 201 side. In the heater holding member 201, a through hole is provided at a position corresponding to the electrodes E (E1 to E7 and E8-1, E8-2). At each of the through hole positions, the electric contact C (C1 to C7 and C8-1, C8-2) as a contact member is electrically connected to the electrode E (E1 to E7 and E8-1, E8-2) by biasing by a spring.

The electric contact C is connected to the control circuit 400 of the heater 300 which will be described later through a conductive material, not shown, fixed onto the heater holding member 201. The conductive material is fitted with a boss, not shown, formed on the heater holding member 201 and fixed thereto. The connecting method between the electrode E and the electric contact C is not limited to biasing by biasing member such as a spring but the electrode E and the electric contact C may be joined by means such as ultrasonic joining, laser welding and the like.

4. Constitution of Heater Control Circuit

Figure 4:
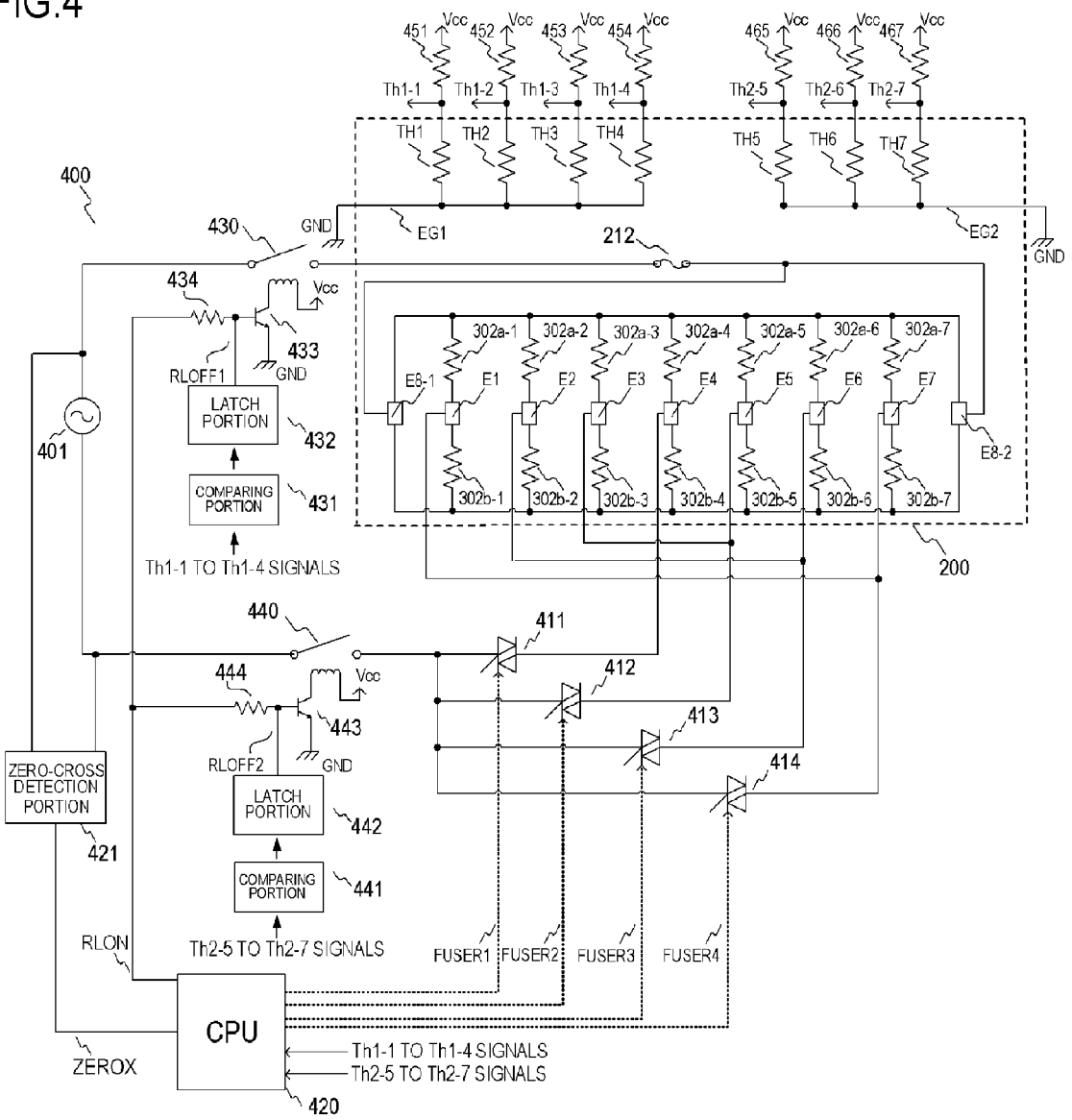
FIG. 4 is a heater control circuit diagram in the embodiment 1.

FIG. 4 illustrates a circuit diagram of the control circuit 400 of the heater 300 in the embodiment 1. To the image forming apparatus 100, the commercial AC power supply 401 is connected. Power control of the heater 300 is performed by electrification/shut-off of a triac 411 to a triac 414. Each of the triac 411 to the triac 414 is operated by a FUSER1 to FUSER4 signals from a CPU 420. Driving circuits of the triacs 411 to 414 are omitted in illustration.

The control circuit 400 of the heater 300 has circuit configuration capable of independently controlling the four sets of the heat-generating blocks. The triac 411 can control the heat-generating block HB4, the triac 412 can control the heat-generating block HB3 and the heat-generating block HB5, the triac 413 can control the heat-generating block HB2 and the heat-generating block HB6, and the triac 414 can control the heat-generating block HB1 and the heat-generating block HB7.

A zero-cross detection portion 421 is a circuit for detecting zero-cross of the AC power supply 401 and outputs a ZEROX signal to the CPU 420. The ZEROX signal is used for detection of phase control timing of the triac 411 to the triac 414 and the like.

A temperature detection method of the heater 300 will be explained. Regarding the temperature detected by the thermistors TH1 to TH4 of the thermistor block TB1, divided voltages by resistors 451 to 454 are detected as Th1-1 to Th1-4 signals by the CPU 420. Similarly, regarding the temperature detected by the thermistors TH5 to TH7 of the thermistor block TB2, the divided voltages by resistors 465 to 467 are detected as Th2-5 to Th2-7 signals by the CPU 420.

In internal processing of the CPU 420, electricity to be supplied is calculated by PI control, for example, on the basis of a set temperature (control target temperature) of each of the heat-generating blocks and a detected temperature of the thermistor. Moreover, it is converted to a control level of a phase angle (phase control) and a wavenumber (wavenumber control) corresponding to the electricity to be supplied, and the triacs 411 to 414 are controlled by control conditions thereof.

A relay 430 and a relay 440 are used as power shut-off member to the heater 300 if the temperature of the heater 300 excessively rises due to a failure or the like.

A circuit operation of the relay 430 and the relay 440 will be explained. When an RLON signal is brought into a High state, a transistor 433 is brought into an ON state, a secondary-side coil of the relay 430 is electrified from a power supply voltage Vcc, and a primary-side contact of the relay 430 is brought into the ON state. When the RLON signal is brought to a Low state, the transistor 433 is brought into an OFF state, an electric current flowing from the power supply voltage Vcc to the secondary-side coil of the relay 430 is shut off, and the primary-side contact of the relay 430 is brought into the OFF state. Similarly, when the RLON signal is brought into a High state, a transistor 443 is brought into the ON state, the secondary-side coil of the relay 440 is electrified from the power supply voltage Vcc, and the primary-side contact of the relay 440 is brought into the ON state. When the RLON signal is brought into the Low state, the transistor 443 is brought into the OFF state, the electric current flowing from the power supply voltage Vcc to the secondary-side coil of the relay 440 is shut off, and the primary-side contact of the relay 440 is brought into the OFF state. A resistor 434 and a resistor 444 are current-limiting resistors.

An operation of a safety circuit using the relay 430 and the relay 440 will be explained. If any one of the temperatures detected by the thermistors TH1 to TH4 exceeds a predetermined value which is set for each of them, a comparing portion 431 operates a latch portion 432, and the latch portion 432 latches an RLOFF1 signal in the Low state. When the RLOFF1 signal is brought into the Low state, even if the CPU 420 brings the RLON signal to the High state, the transistor 433 is held in the OFF state and thus, the relay 430 can be held in the OFF state (safe state). The latch portion 432 makes the RLOFF1 signal an output in an open state in a non-latch state.

Similarly, if any one of the temperatures detected by the thermistors TH5 to TH7 exceeds a predetermined value which is set for each of them, a comparing portion 441 operates a latch portion 442, and the latch portion 442 latches an RLOFF2 signal in the Low state. When the RLOFF2 signal is brought into the Low state, even if the CPU 420 brings the RLON signal to the High state, the transistor 443 is held in the OFF state and thus, the relay 440 can be held in the OFF state (safe state). Similarly, the latch portion 442 makes the RLOFF signal an output in an open state in a non-latch state.

5. Detailed Explanation of Position of Thermistor to Heat-Generating Resistor

Figure 5A:
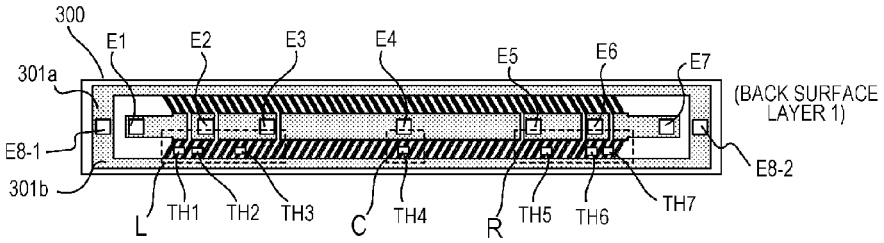
FIGS. 5A to 5E are positional relation diagrams between a thermistor and a heat-generating resistor in the embodiment 1.
Figure 5B:
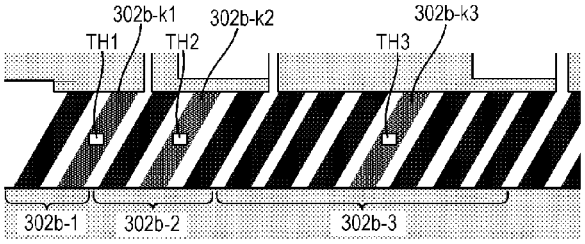
Figure 5C:
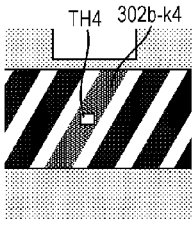
Figure 5D:
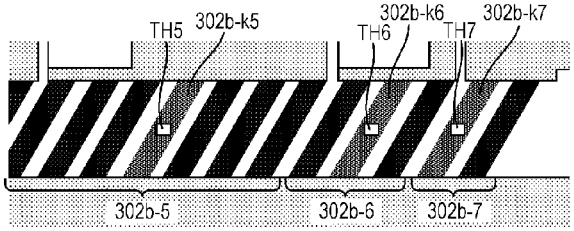

FIGS. 5A to 5E are views for explaining a relation between detailed positions of the thermistors TH1 to TH7 and a position of the heat-generating resistor 302*b*. FIG. 5A is a view of the heater 300 when seen in a direction perpendicular to the surface of the substrate 305, and the positional relation with the heat-generating resistor is illustrated by illustrating the positions of the thermistors TH1 to TH7 overlapping the back surface layer 1. FIGS. 5B to 5D are enlarged views of portions L, C, and R in FIG. 5A, respectively, and illustrate the positional relations between the thermistors and the heat-generating resistors in more detail.

As illustrated in FIG. 5A, each thermistor of the thermistors TH1 to TH7 is installed in the heat-generating blocks corresponding to them (positions overlapping the corresponding heat-generating blocks on a plan view in the direction perpendicular to the surface of the substrate 305). Here, assuming that the heat-generating resistors which are closest to the thermistors TH1 to TH7 are heat-generating resistor 302*b-k* (302*b-k*1 to 302*b-k*7), and they are illustrated in FIGS. 5B to 5D. In this embodiment, as illustrated in FIGS. 5B to 5D, the thermistors TH1 to TH7 are disposed at intersections of diagonal lines of a parallelogram of the heat-generating resistor 302*b-k* which is the closest to each of them, that is, at a gravity center position (disposed at a position where the gravity center of the plan-view shape of each of them matches the gravity center of a plan-view shape of the heat-generating resistor 302*b-k*).

6. Effects of Embodiment 1

Figure 6A:
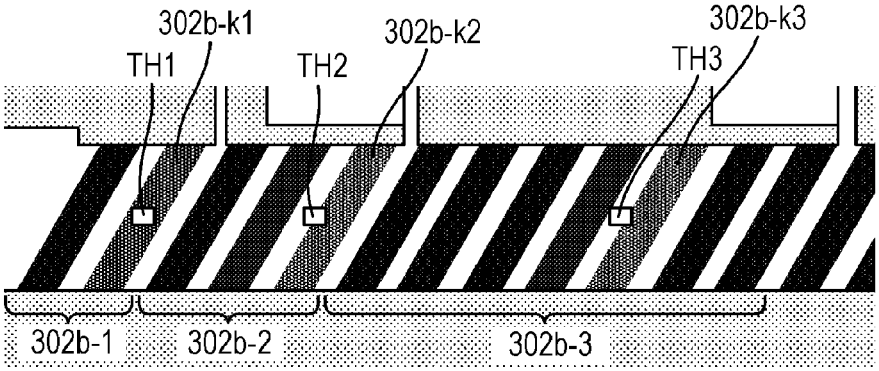
FIGS. 6A to 6C are positional relation diagrams between the thermistor and the heat-generating resistor in a comparative example.
Figure 6B:
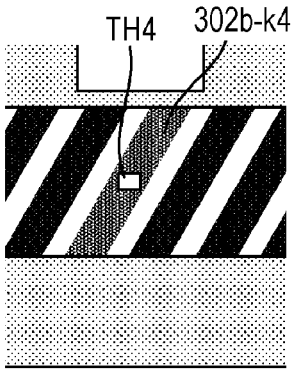
Figure 6C:
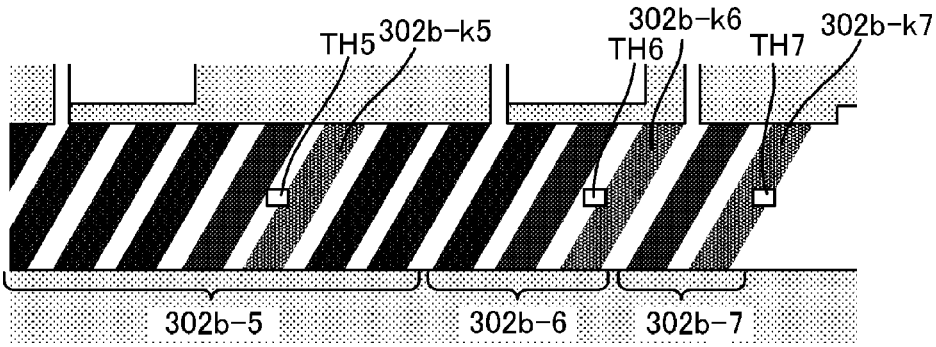

A form of a comparative example will be explained by using FIGS. 6A to 6C. In the comparative example, a state where the positional relation between each of the thermistors TH1 to TH7 and the closest heat-generating resistor 302*b-k* is not unified is illustrated. FIGS. 6A, 6B, and 6C correspond to FIGS. 5B, 5C, and 5D of the embodiment 1 and illustrate positions of TH1 to TH7 and the heat-generating resistor 302*b-k* in the comparative example. Similarly to the embodiment 1, regarding the thermistor TH1 and the thermistor TH4 in the comparative example, the thermistor center (gravity center position of the plan-view shape) is located at the gravity center of the parallelogram of the closest heat-generating resistor 302*b-k*. The thermistors TH2 and TH7 have the thermistor centers at the positions close to the long side of the heat-generating resistor 302*b-k*. The thermistors TH3, TH5, and TH6 have the thermistor centers disposed at the positions where there are no heat-generating resistors.

Temperature distribution in the longitudinal direction of the heater is compared between the embodiment 1 and the comparative example by using FIGS. 7A to 7C and 8, and the effect of the embodiment 1 will be explained.

Temperature detection positions of the thermistors TH1 to TH7 and the temperature distribution on the heater sliding surface close to the heat-generating resistor 302*b-k* in a state where the heater is made to generate a heat is illustrated in FIGS. 7A to 7C. When the heat-generating resistor of the parallelogram is electrified, a heat generation amount is changed by integration of the electrification path and thus, the temperature distribution as illustrated in FIG. 7A is generated.

Figure 8:
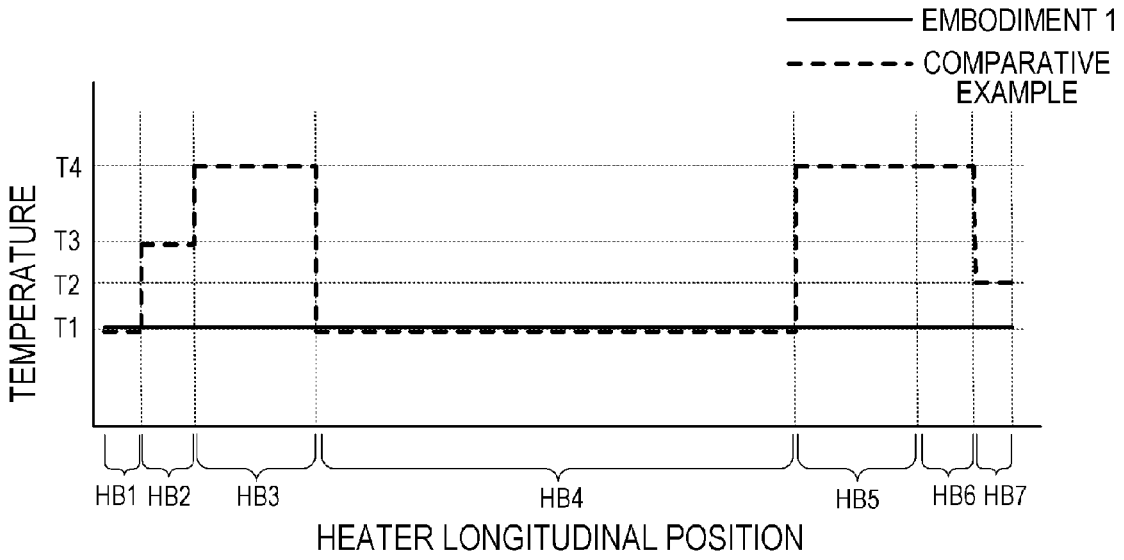
FIG. 8 is a distribution diagram of an average temperature of each of heat-generating blocks.
Figure 9A:
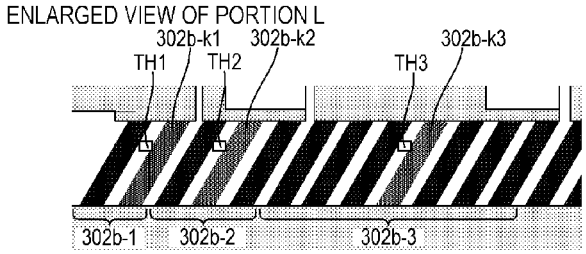
FIGS. 9A to 9D are positional relation diagrams between the thermistor and the heat-generating resistor in another form of the embodiment 1.
Figure 9B:
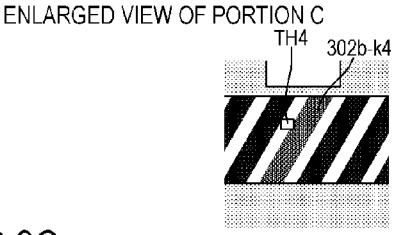
Figure 9C:
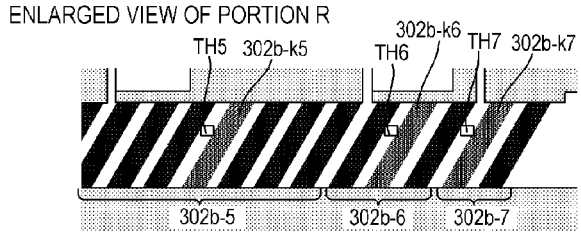
Figure 9D:
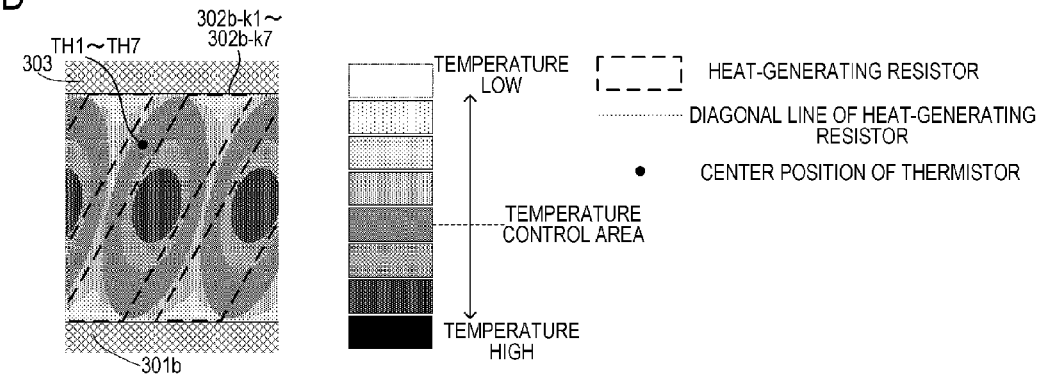

FIG. 8 illustrates an average temperature of each of the heat-generating blocks on the heater sliding surface. As illustrated in FIG. 7A, all the thermistors TH1 to TH7 detect a spot where the temperature is high in the heat-generating resistor 302*b-k* in the embodiment 1. Thus, even if temperature control is executed so that all the thermistors TH1 to TH7 have the same temperature, no difference is generated in the average temperature among a plurality of the heat-generating blocks aligned in the heater longitudinal direction and thus, all the heat-generating blocks can be controlled to the same temperature T1 as illustrated in FIG. 8. FIG. 7B illustrates temperature distribution of the heat-generating resistor 302*b-k* when the same voltage is applied between the conductors 301 and 303 in the comparative example. The thermistors TH1 and TH4 in the comparative example detect a spot where the temperature is high in the heat-generating resistor 302*b-k* similarly to the embodiment 1, and as indicated by a broken line in FIG. 8, the average temperature of the heat-generating blocks HB1 and HB4 are the same temperature T1 as that in the embodiment 1.

On the other hand, spots where the thermistors are installed are different depending on an order from a high temperature with respect to the temperature distribution by the heat-generating resistors (TH1, TH4>TH7>TH2>TH3, TH5, TH6). Thus, in the comparative example, if the temperature control is executed on the basis of the same temperature detected by each of the thermistors, the heat-generating blocks have temperature distribution as illustrated in FIG. 7C, and the entire heater long side has the temperature distribution as indicated by the broken line in FIG. 8.

In the comparative example, the thermistor TH7 detects a spot where the temperature distribution is lower than the thermistors TH1 and TH4 in the neighborhood of the heat-generating resistor 302*b-k*. However, since the temperature control is executed such that the spot where the thermistor TH7 is located has the controlled temperature (control target temperature), the temperature of the heat-generating resistor 302*b*-7 is higher than those of the heat-generating resistors 302*b*-1 and 302*b*-4. Thus, as indicated by the broken line in FIG. 8, the average temperature of the heat-generating block HB7 is a temperature T2 which is higher than a temperature T1.

In the comparative example, the thermistor TH2 detects a spot where the temperature distribution is further lower than the thermistor TH7 in the neighborhood of the heat-generating resistor 302*b-k*. The temperature control is executed such that the spot where the thermistor TH2 is located has the controlled temperature (control target temperature), and the temperature of the heat-generating resistor 302*b*-2 becomes higher than the heat-generating resistor 302*b*-7. Thus, as indicated by the broken line in FIG. 8, the average temperature of the heat-generating block HB7 becomes a temperature T3 which is higher than the temperature T2.

In the comparative example, the thermistors TH3, TH5, and TH6 detect a spot where the temperature distribution is further lower than the other thermistors in the neighborhood of the heat-generating resistor 302*b-k* and executes temperature control. Thus, as indicated by the broken line in FIG. 8, the average temperature of the heat-generating blocks HB3, HB5, and HB6 becomes a temperature T4 which is higher than the temperature T3. As described above, in the comparative example, the average temperature of each of the heat-generating blocks takes various temperatures T1 to T4, and a temperature difference is generated among the heat-generating blocks. On the other hand, in the embodiment 1, the average temperature of the heat-generating blocks is unified to T1, and the temperature difference is not generated. Thus, the longitudinal non-uniformity in the fixing performance and gloss is hardly generated in the form of the embodiment 1 as compared with the comparative example.

In this embodiment, the form in which the positions of the thermistors TH1 to TH7 are located at the gravity center of the parallelogram of the heat-generating resistor 302*b-k* is employed, but under a condition that the positional relation between the heat-generating resistor and the thermistor is kept, they may be located at positions different from the gravity center position as in the form illustrated in FIGS. 9A to 9D. That is, the gravity center in the plan-view shape is used in this embodiment as a reference so that the relative positional relation between the heat-generating resistor and the thermistor is matched between the desired heat-generating blocks, but such constitution is not limiting, and a reference position different from the gravity center may be used. FIGS. 9A to 9D illustrate an example of the case which the thermistor and the heat-generating resistor do not overlap in each heat-generating block, and it is also possible to apply such configuration to the present invention. Moreover, in this embodiment, the plurality of heat-generating resistors and thermistors are assumed to have the same shape, respectively, but different shapes may be combined in the constitution as long as the uniformity of the average detected temperatures can be achieved between the desired heat-generating blocks.

Figure 5E:
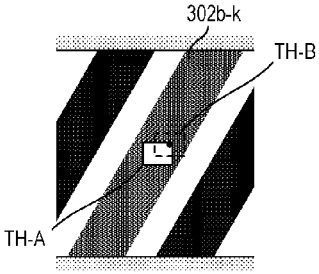

Moreover, whether the relative positional relation between the heat-generating resistor and the thermistor is the same or not may be determined as follows. That is, when the positions of the arbitrary two thermistors are compared with the heat-generating resistor 302*b-k* (when the position of the first thermistor and the position of the second thermistor are compared when the set of the first heat-generating resistor and the first thermistor and the set of the second heat-generating resistor and the second thermistor are seen by virtually having them overlapped with each other so that the positions of the heat-generating resistors are matched), if the center position of another thermistor is present within a range where the thermistor as the reference is present, it can be considered that these two thermistors have the same relative positional relation between the heat-generating resistor and the thermistor. That is, by containing those including a manufacture tolerance in the aforementioned range, the performance of this case can be satisfied. FIG. 5E illustrates a relation between the two thermistors TH-A and TH-B whose relative positional relation can be regarded as the same. As illustrated in FIG. 5E, since a center position TH-Bz of the thermistor TH-B is present within a range where the thermistor TH-A is present, the relative positional relation between the heat-generating resistor and the thermistor can be regarded as the same. It also applies to a case where the thermistor as a component separate from the heater is used, and even in the case where the thermistor has a heat collecting member such as an aluminum foil or the like, it is only necessary that the positional relation between heat collecting members is such positional relation as illustrated in FIG. 5E.

Moreover, this embodiment employs the form in which the positional relations of the heat-generating resistors are the same for all the thermistors, but this is not limiting. That is, such a form in which the positional relation of the heat-generating resistor is the same only for the thermistor of the heat-generating block for which a temperature difference between the heat-generating blocks is to be suppressed may be employed in accordance with circumstances specific to the image heating device. For example, since the temperatures of the heat-generating blocks HB1 and HB7 on the end portion side of the heater can easily lower due to heat escaping, such control is desired that the average temperature of the heat-generating blocks HB1 and HB7 becomes higher in some cases. In such a case, the thermistors TH2 to TH6 are disposed at positions of the gravity center of the parallelogram of the heat-generating resistor 302*b-k* similarly to the embodiment 1. On the other hand, the thermistors TH1 and TH7 disposed at the farthest ends in the longitudinal direction of the heater 300 may be disposed at positions different from those of the thermistors TH2 to TH6 so that the average temperature of the heat-generating blocks HB1 and HB7 becomes higher. Also in this case, the temperature difference in the longitudinal direction can be suppressed among the heat-generating blocks HB2 to HB6.

Moreover, in this embodiment, the thermistor employs such a form integrated with the heater in which a material having the TCR characteristic is printed/formed thinly on the substrate, but this is not limiting. For example, also in the case where the thermistor, as a component separate from the heater, for detection in contact with the heater outside the heater is used, the similar effect can be obtained by defining the positional relation with the heat-generating resistor.

Embodiment 2

An embodiment 2 of the present invention has constitution considering an influence by rotation of the fixing film. In the constitution of the embodiment 2, the same symbols are used for the constitution similar to those in the embodiment 1, and the explanation will be omitted.

Figure 10A:
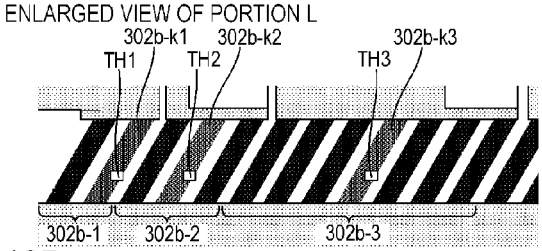
FIGS. 10A to 10E are sectional views of the image forming apparatus.
Figure 10B:
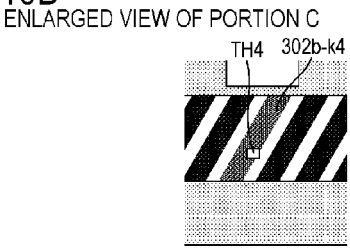
Figure 10C:
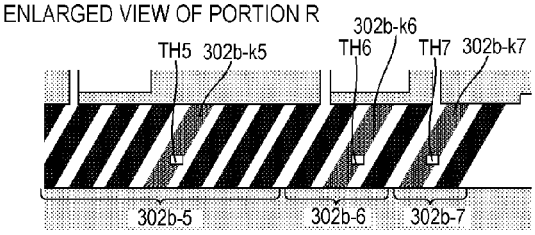
Figure 10D:
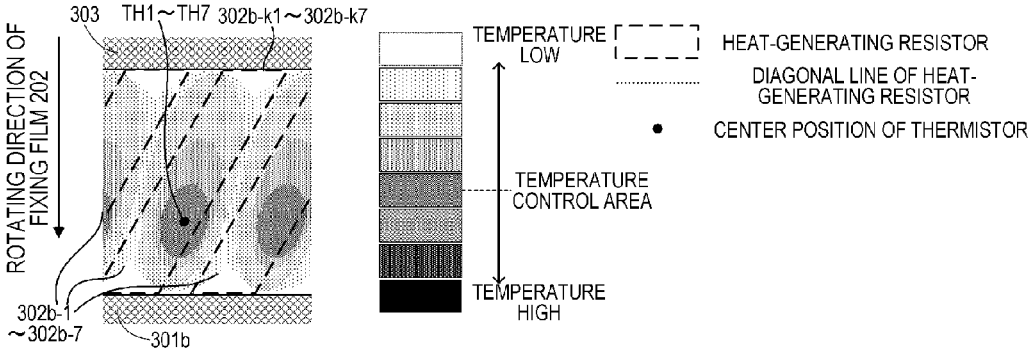
Figure 10E:
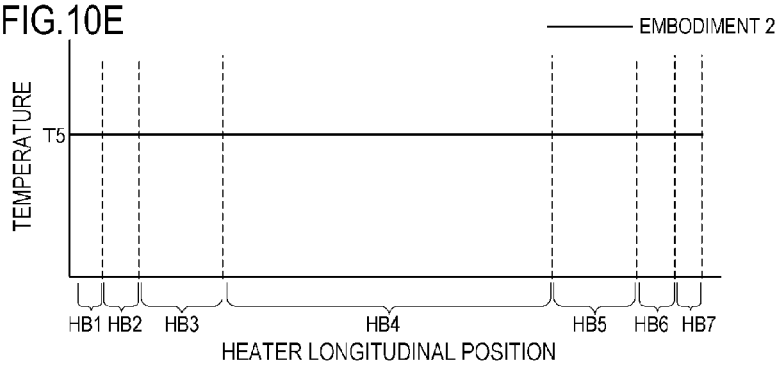
Figure 11:
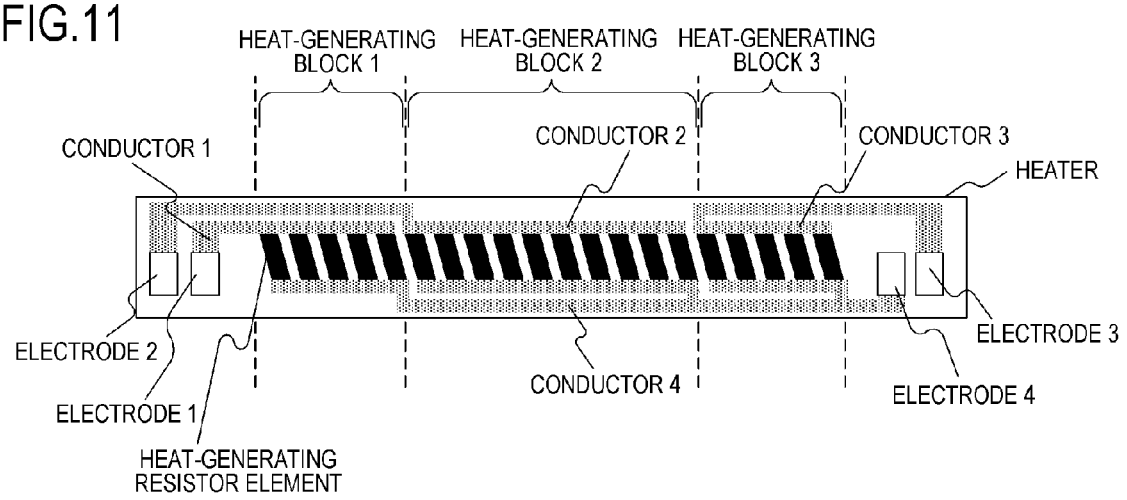
FIG. 11 is a heater configuration diagram in a reference example.
Figure 12A:
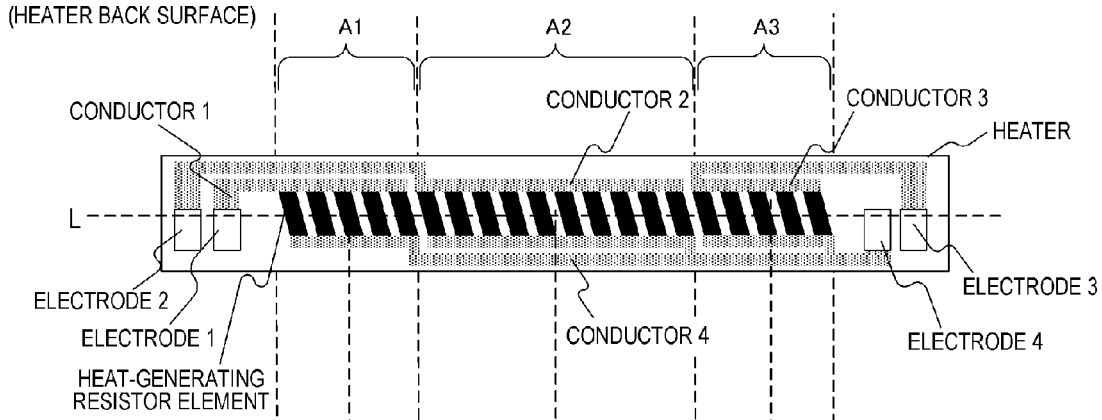
FIGS. 12A to 12C are temperature distribution diagrams of the heater in the reference example.
Figure 12B:
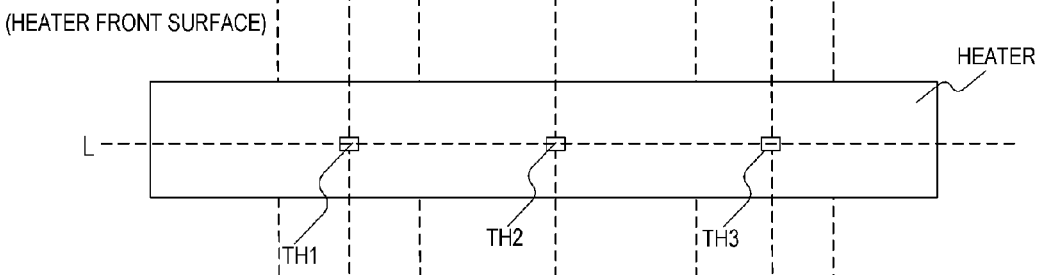
Figure 12C:
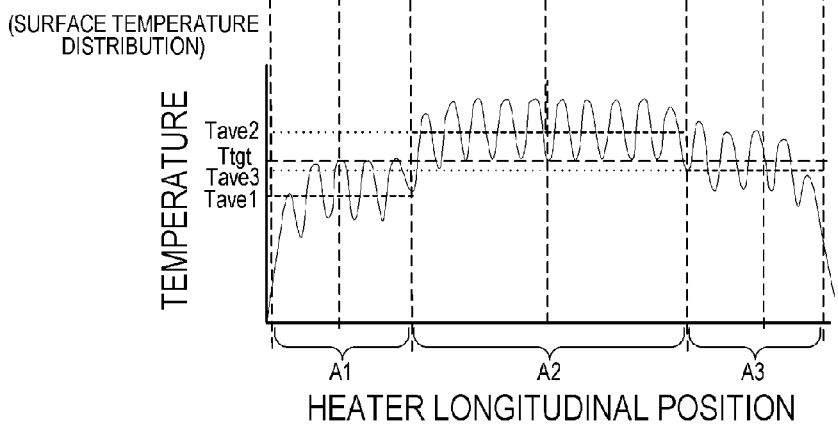

FIGS. 10A to 10E illustrate views of relations between the positions of the thermistors TH1 to TH7 and the heat-generating resistor 302*b* in the embodiment 2 and the temperature distribution. FIGS. 10A to 10C illustrate the detailed positions of the thermistors TH1 to TH7 and the position of the heat-generating resistor 302*b*. FIG. 10D illustrates the temperature distribution of the sliding surface layer 2 in the heater 300 in the neighborhood of the heat-generating resistor 302*b-k* during rotation of the fixing film (rotation of the pressurizing roller). FIG. 10E illustrates distribution of the average temperature of each of the heat-generating blocks on the heater sliding surface.

As illustrated in FIGS. 10A to 10C, the thermistors TH1 to TH7 are located slightly closer to the downstream than that in the embodiment 1 in the fixation film rotating direction. When the fixing film 202 is rotated by rotation of the pressurizing roller 208, a temperature of the fixing film 202 at the fixing nip portion N has distribution higher on the downstream side than on the upstream side in the fixing film rotating direction. That is, a temperature peak (maximum value) of the temperature distribution is shifted from a state as in FIG. 7A in which the heater 300 generates heat to a state as in FIG. 10D by the rotation of the fixing film 202. Thus, in this embodiment, the thermistors TH1 to TH7 are disposed so that they can detect the temperature peak in the temperature distribution in the neighborhood of the heat-generating resistor 302*b-k* in FIG. 10D.

Also in the embodiment 2, similarly to the embodiment 1, since the positional relations between the thermistors TH1 to TH7 and the heat-generating resistor 302*b-k* are the same, respectively, no difference is generated in the average temperature among the heat-generating blocks as illustrated in FIG. 10E. As a result, longitudinal non-uniformity in the fixing performance or gloss is hardly generated. Moreover, in the form of the embodiment 2, since the temperature is detected by the thermistors TH1 to TH7 at a spot where the temperature of the heater 300 is high when the fixing film 202 is being rotated and the temperature control is executed, overshoot of the temperature of the heater 300 can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-025444, filed on Feb. 18, 2020, which is hereby incorporated by reference herein in its entirety.

What is claimed is:

1. An image heating device comprising:

a heater having a substrate and a plurality of heat-generating blocks arranged on the substrate along a longitudinal direction of the substrate, the plurality of heat-generating blocks being independently controllable, wherein each of the plurality of heat-generating blocks includes a first conductor provided on the substrate along a longitudinal direction of the substrate, a second conductor provided along the longitudinal direction at a position different from the first conductor on the substrate in a direction orthogonal to the longitudinal direction, and a plurality of heat-generating resistors, each having the same shape and electrically connected in parallel between the first conductor and the second conductor on the substrate;

a plurality of temperature detection elements for detecting a temperature of the heater, wherein each of the plurality of temperature detection elements is disposed at each of the plurality of heat-generating blocks; and a control portion for controlling electricity to be supplied to the plurality of heat-generating blocks based on the temperatures detected by the plurality of temperature detection elements, wherein the image heating device heats an image formed on a recording material by using a heat of the heater; and wherein the plurality of temperature detection elements include at least two temperature detection elements whose relative positions with respect to the closest heat-generating resistor among the plurality of heat-generating resistors in each of the plurality of the heat-generating blocks are the same, respectively, the closest heat-generating resistors corresponding to the at least two temperature detection elements are independently controlled by the control portion.

2. The image heating device according to claim 1, wherein the plurality of temperature detection elements are disposed at the same relative positions excluding at least the temperature detection element disposed on a farthest end in the longitudinal direction.

3. The image heating device according to claim 1,
wherein the plurality of temperature detection elements are provided on a surface of the substrate on a side opposite to a surface on which the first conductor, the second conductor, and the heat-generating resistor are provided.

4. The image heating device according to claim 1,
wherein the plurality of temperature detection elements are provided outside the heater.

5. The image heating device according to claim 1,
wherein the relative positions are relative positions between a gravity center of the heat-generating resistor and the gravity center of the temperature detection element on a plan-view shape when seen in a direction perpendicular to the surface of the substrate.

6. The image heating device according to claim 1,
wherein the image heating device further includes:
a cylindrical film; and
a pressurizing rotating member in contact with an outer surface of the film,
wherein the heater is disposed inside the film, and
wherein a nip portion for conveying the recording material is formed by the heater and the rotating member through the film.

7. The image heating device according to claim 6,
wherein the at least two temperature detection elements are disposed at positions where a maximum temperature in temperature distribution of the closest heat-generating resistor is detectable during rotation of the pressurizing rotating member.

8. The image heating device according to claim 6,
wherein a gravity center of the temperature detection element on the plan-view shape when seen in the direction perpendicular to the surface of the substrate is located closer to a downstream side in a rotating direction of the pressuring rotating member than a gravity center of the heat-generating resistor.

9. The image heating device according to claim 1, wherein
a gravity center of the heat-generating resistor on a plan-view shape when seen in a direction perpendicular to a surface of the substrate matches a gravity center of the temperature detection element.

10. An image forming apparatus comprising:
an image forming portion for forming an image on a recording material; and
a fixing portion for fixing the image formed on the recording material to the recording material,
wherein the fixing portion is the image heating device according to claim 1.

11. A heater used for heating an image formed on a recording material, comprising:
a substrate; and
a plurality of heat-generating blocks arranged on the substrate along a longitudinal direction of the substrate, the plurality of heat-generating blocks being independently controllable, each of the plurality of heat-generating blocks including
a first conductor provided on the substrate along a longitudinal direction of the substrate,
a second conductor provided along the longitudinal direction at a position different from the first conductor on the substrate in a direction orthogonal to the longitudinal direction;
a plurality of heat-generating resistors, each having the same shape and electrically connected in parallel between the first conductor and the second conductor on the substrate, and
a plurality of temperature detection elements provided on a surface of the substrate on a side opposite to a surface on which the first conductor, the second conductor, and the heat-generating resistors are provided,
wherein the plurality of temperature detection elements include at least two temperature detection elements whose relative positions with respect to the closest heat-generating resistor among the plurality of heat-generating resistors in each of the plurality of the heat-generating blocks are the same, respectively, the closest heat-generating resistors corresponding to the at least two temperature detection elements are independently controlled.

* * * * *